US005809154A

United States Patent [19]

Polk

[11] Patent Number: 5,809,154

[45] Date of Patent: Sep. 15, 1998

[54] PORTED LOUDSPEAKER SYSTEM AND METHOD

[75] Inventor: Matthew S. Polk, Baltimore, Md.

[73] Assignee: Britannia Investment Corporation, Wilmington, Del.

[21] Appl. No.: 453,557

[22] Filed: May 26, 1995

Related U.S. Application Data

[63] Continuation of Ser. No. 177,080, Jan. 4, 1994, abandoned.

[51] Int. Cl.[6] ..... H04R 25/00

[52] U.S. Cl. ..... 381/159; 381/160; 381/154; 181/156; 181/160; 181/199

[58] Field of Search ..... 381/158, 159, 381/160, 150, 154, 188, 205; 181/155, 156, 160, 199

[56] References Cited

U.S. PATENT DOCUMENTS 4,611,686 9/1986 Kobayashi et al. ..... 181/156

5,056,616 10/1991 Astrom ..... 181/156

FOREIGN PATENT DOCUMENTS 0289399 11/1989 Japan ..... 381/159

*Primary Examiner*—Curtis A. Kuntz

*Assistant Examiner*—Xu Mei

*Attorney, Agent, or Firm*—Snell & Wilmer

[57] ABSTRACT

A vent loudspeaker system is provided which has at least one active driver and a port opening in a speaker cabinet. Disks or baffle plates are mounted a predetermined distance to and concentric to the port opening, resulting in a vented system achieving an equivalent performance as would result from a flared, ducted port, but with several performance advantages and simpler construction.

5 Claims, 5 Drawing Sheets

PORTED LOUDSPEAKER SYSTEM AND METHOD

This is a File Wrapper Continuation of application Ser. No. 08/177,080 filed Jan. 4, 1994, abandoned.

BACKGROUND OF THE INVENTION

This invention relates generally to loudspeaker systems, and in particular relates to a vented loudspeaker system having a unique port geometry and corresponding method of porting the loudspeaker in an efficient manner.

Vented box loudspeaker systems have been popular for at least 50 years as a means of obtaining greater low frequency efficiency from a given cabinet volume. Great advances were made in understanding and analyzing vented loudspeaker systems through the work of Theile and Small during the 1970's, and the proliferation of personal computers and easy to use software has enhanced the ability to optimize vented loudspeaker system designs. Practical considerations, however, often impede or prevent actual construction of optimized loudspeaker system designs.

There are two basic approaches in common use in connection with vented loudspeaker systems, these being the ducted port and the passive radiator. Each of these approaches has its advantages and disadvantages.

In the case of the ducted port approach, the advantages include the fact that it is inexpensive to implement and requires very little space on the loudspeaker cabinet baffle. Additionally, there are no mechanical limits on air volume velocity and these are low mechanical losses. Finally, there are no moving parts involved in a ducted port approach and the arrangement is insensitive to physical orientation.

There are, however, disadvantages to the ducted port approach. For example, if the diameter of the port is too small, non-linear behavior such as chuffing or port-noise due to air turbulence can result. Organ pipe resonances proportional to the length of the port can also be a problem, as can transmission of undesirable mid-range frequencies from inside of the loudspeaker cabinet. In addition, the acoustic mass of air required to achieve certain desirable low frequency tunings suggest the use of a large diameter duct which is impractically long in order to keep port-noise and turbulence to an acceptable minimum. The compromise use of a smaller diameter duct is shorter but often produces annoying amounts of port-noise and may become highly inefficient due to turbulence.

In the case of using passive radiators in a vented loudspeaker system, the advantages include the fact that lower frequency box tunings are easily achieved, and there are no organ pipe resonance problems. Moreover, mid-range transmissions from inside of the loudspeaker cabinet are substantially eliminated, greater efficiency is achieved due to larger radiating surfaces, and chuffing or "port-noise" is essentially absent.

There are unfortunately disadvantages to use of a passive radiator approach. These include the higher cost to implement such an approach, as well as the inherent mechanical limits on air volume velocity. Moreover, passive radiators are sensitive to physical orientation and require more space on the loudspeaker baffle than the ducted port approach. Finally, passive radiator systems involve greater mechanical losses than a ducted port and the suspension of the passive radiator reduces system total compliance and limits linearity.

SUMMARY OF THE INVENTION

In accordance with one embodiment of the invention, a unique port geometry is provided in a vented system which overcomes many of the difficulties associated with standard ducted ports and achieves many of the advantages of passive radiators, but without the disadvantages. Briefly, the system and method of the present invention provide a technique to achieve the same operation as would be provided by a flared ducted port, but with several performance advantages and a much simpler, lower cost of implementation. This is achieved through provision of a port in the speaker baffle, with the necessary additional acoustic mass to achieve a desired tuning frequency being provided by one or more disks or baffle plates of a predetermined size being provided more or less concentric to and adjacent the port but spaced therefrom by a predetermined distance. This creates a duct with in essence a flared cross-section at either end which offers no straight-line path from the air volume inside the cabinet to the air outside the cabinet.

Other objectives and advantages of the invention will be described in and apparent from the detailed description of the invention taken in conjunction with the accompanying drawings.

DETAILED DESCRIPTION

Figure 1:
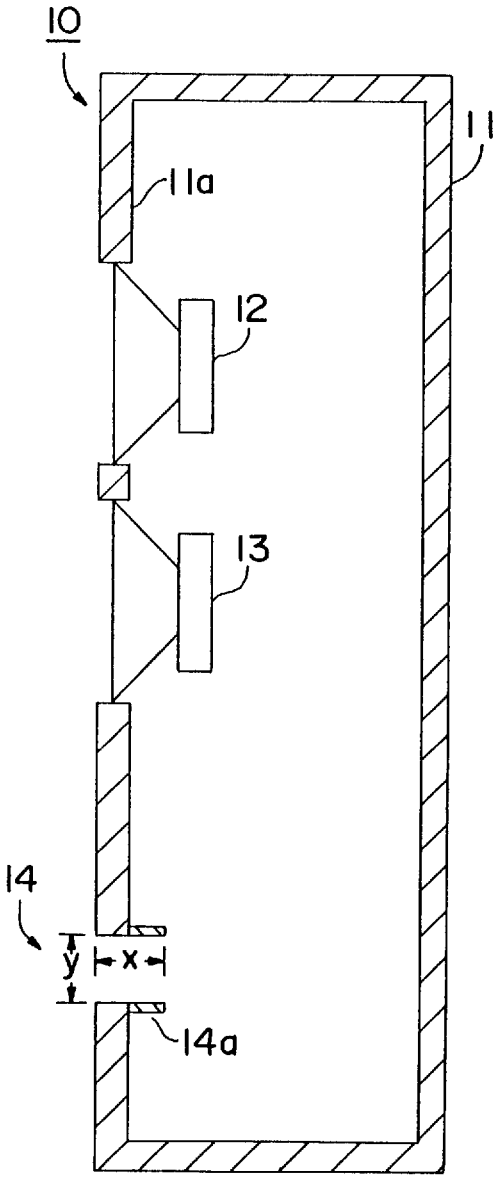
FIG. 1 PRIOR ART
FIG. 1 is a diagrammatic side sectional view of a conventional prior art ducted port loudspeaker system.

As mentioned above, there are advantages and disadvantages to implementing a vented loudspeaker system using a ducted port approach. The major problem with the simpler, lower cost ducted port revolves around the fact that solving one set of problems creates another set of problems. Referring to FIG. 1, for example, there is diagrammatically illustrated a side sectional view of a conventional, prior art, ducted port system. The loudspeaker system generally indicated by reference numeral 10 includes a cabinet 11 having a front baffle 11*a* mounting two active drivers 12 and 13. A port generally indicated by reference numeral 14 and having a diameter Y is formed in front baffle 11*a*. Ducting 14*a* extends a distance X back into the interior of cabinet 11. If the ducted port of FIG. 1 is configured such that the port 14 has a diameter Y of 2.000 inches, and the length X of ducting 14*a* is 2.250 inches, the length of ducting 14*a* is sufficiently short to place the lowest organ pipe resonance, approximately 3 kHz, above the operating range of the drive units 12 and 13. However, the small diameter of port 14 results in chuffing or "port-noise" due to air turbulence.

One solution to the chuffing or "port-noise" is, of course, to make the port larger in diameter. However, if the diameter Y of the port is made larger, then the length of the ducting must be increased, leading to a shifting of organ pipe resonances of the duct to objectionable lower frequencies. For example, if the diameter Y of the port in FIG. 1 is made to be 2.534 inches, then the proper length X of ducting 14*a* becomes 4.500 inches, a substantial increase. Generally, the ducting length X must be increased as the square of the increase in port diameter. Unfortunately, this increase in duct length X means that the organ-pipe resonances of the duct are shifted to lower frequencies, in this case approximately 1,400 Hz, well with the range of drive units 12 and 13.

Figure 2:
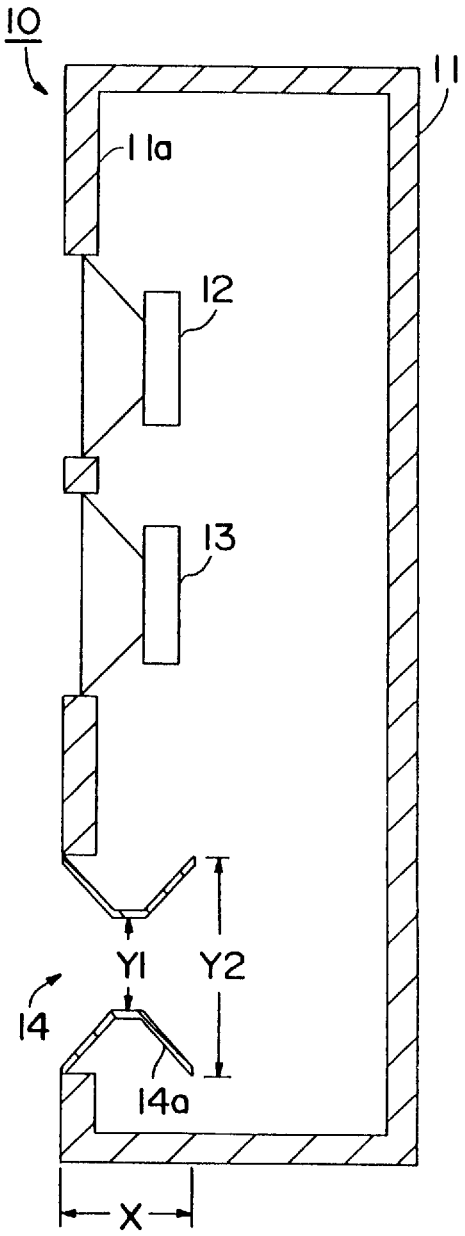
FIG. 2 PRIOR ART
FIG. 2 is a diagrammatic side sectional view of a prior art ducted port loudspeaker system similar to FIG. 1, but in which the ends of the port ducting are flared.

One possible approach to solving the competing considerations of chuffing or "port-noise" and organ-pipe resonances is to flare the ends of the ducted approach. FIG. 2 is a diagrammatic side sectional view of such a prior art approach, and in FIG. 2 like reference numerals have been used as in FIG. 1 to indicate corresponding structure. In FIG. 2, loudspeaker system 10 has a cabinet 11 having a front baffle or wall 11*a* mounting two active drivers 12 and 13. In this case, the port 14 is formed of ducting 14*a* having a flared opening at either end. A system constructed as in FIG. 2 with an inner port diameter Y1 of 2.769 inches, an outer port diameter Y2 of 6.000 inches, and a duct length X of 4.000 inches, functions very effectively. In particular, the flared port geometry of a system as in FIG. 2 mitigates port-noise, tends to suppress organ-pipe resonances, and increases efficiency by offering a larger effective radiating area. However, flared duct ends in a port geometry as in FIG. 2 are quite costly to implement, add to the length of the ducted port disproportionately thus taking up additional room inside the loudspeaker cabinet, and may increase the undesirable transmission of mid-range energy from the inside of the cabinet. In working with small loudspeaker cabinet volumes all of these problems become worse in that even larger ducts are required to achieve the desired tuning frequencies.

Although more costly, passive radiators do not suffer from these problems and can be made as heavy as required to achieve a given box tuning. However, they are mechanically limited and must typically be larger in diameter than the active drive units to generate adequate air volume velocities. This essentially eliminates them from consideration in small systems with minimal baffle areas. In addition, passive radiator suspensions must be very compliant in order to avoid reducing the overall compliance of the system significantly. As a result, there are practical limits on how much weight that suspension can reliably carry. Furthermore, the combination of added weight and compliant suspension makes the use of passive radiators in downward or upward orientations difficult due to the long term tendency of the suspension to sag.

Figure 3:
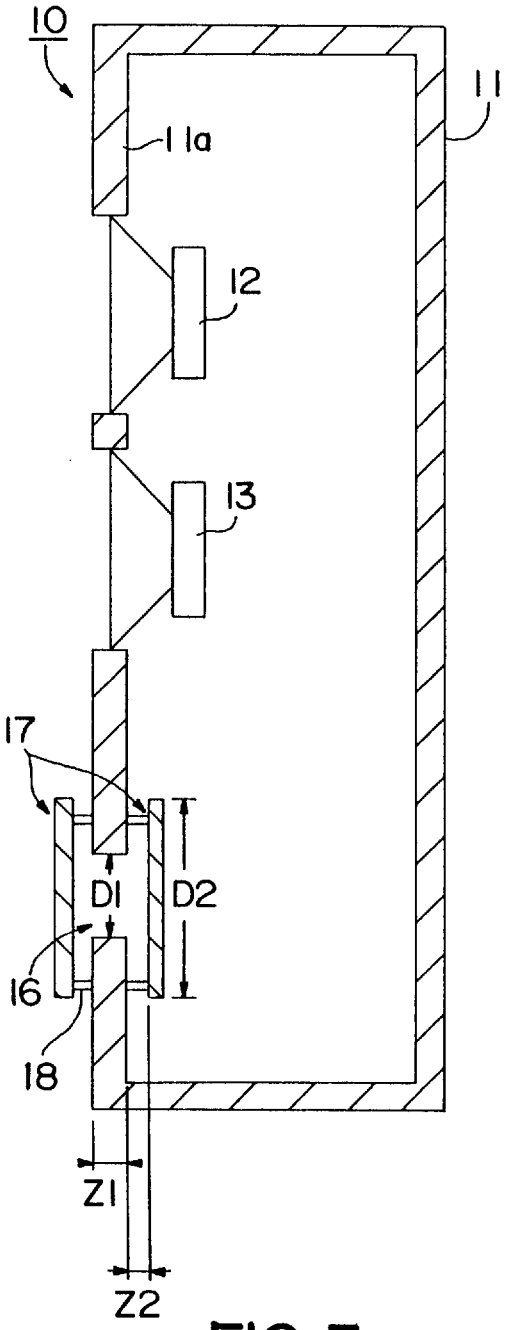
FIG. 3 is a diagrammatic side sectional view of a ducted port loudspeaker system in accordance with one embodiment of the invention, using spaced discs or plates mounted concentric to and spaced from the port opening.

The present invention is based on the discovery that a unique port geometry can be provided which overcomes many of the difficulties associated with standard ducted ports and achieves many of the advantages of passive radiators, but without the disadvantages. In essence, the present invention achieves the same operation as a flared, ducted port but with several performance advantages and a much simpler, lower cost of implementation. FIG. 3 shows a diagrammatic side sectional view of one embodiment of the present invention. In FIG. 3, as in the prior art, a loudspeaker system 10 includes a cabinet 11 having a front baffle 11*a* mounting active drivers 12 and 13. In accordance with the present invention, however, and differing from the prior art, a port 16 is configured by cutting a hole in the front baffle, with the port 16 having a diameter D1 and a depth or length Z1. The necessary acoustic mass to achieve the same tuning frequency as in a conventional port ducted system as shown in FIG. 1 is achieved by providing disks or plates 17 of a specified size or diameter D2 disposed more or less concentric to port 16 on either side of the baffle 11*a* and spaced a predetermined distance Z2 from the baffle. The distance Z2 between each of the disks and the baffle is chosen such that the area of the cylindrical surface between each disk 17 and the baffle or cabinet wall and formed by the extension of the port opening 16, is approximately equal to the area of the port itself. The diameter of disks 17 can be somewhat arbitrarily chosen based on the available baffle area. It is only required that the area of the cylindrical surface formed by the outer part of the space between the baffle and each disk 17 be significantly larger than the area of the port. Thereby, a smooth transition is made from the area of port opening 16 to the large area at the edge of the disks 17 outside and inside the cabinet. Basically, what results with the configuration of FIG. 3 is an acoustic mass of air defined by a duct having a cross sectional area which varies according to a continuous (or piece-wise continuous) function from inside to outside the cabinet and which increases monotonically from a minimum value along its midsection to a larger cross-section at either end. The acoustic mass of air is tuned to a single frequency and moves substantially as a unitary mass in the process of radiating sound. It should be noted that the duct thus configured has what can be referred to as essentially a flared cross-section at either end which does not have any straight-line path from the air volume inside the cabinet to the air outside the cabinet.

The disks or plates 17 are suitably mounted to the front baffle 11*a* by any suitable means which will not interfere significantly with air flow, such as by small struts 18 which can be glued or otherwise affixed between the baffle and disks 17. However, it is beneficial to place such mounting struts as far as possible from the port opening 16 due to the higher velocity of air in the vicinity of the port opening. For the same reason it is desirable to round-off or chamfer the edges of port opening 16 to reduce turbulence in the area of highest air velocity. The duct opening at either end thus essentially comprises an opening which extends substantially around the perimeter of the disks or plates 17. In accordance with a particular implementation of the arrangement of FIG. 3, the diameter of port 16 was 2.613 inches, the diameter of disks 17 was 6.000 inches, the depth or length D1 of port 16 was 1.000 inches, and the spacing Z2 between the baffle 11*a* and disks 17 was 0.640 inches.

The operation of the loudspeaker system of FIG. 3 in accordance with the present invention is comparable to that of a flared duct system such as shown in FIG. 2, except that it enjoys several advantages. The FIG. 3 configuration in accordance with the invention is compact and cost effective to implement, and suppresses undesirable transmission of higher frequencies from the inside to the outside of the cabinet 11. Moreover, the present invention places the input of the port 16 in the highest pressure region inside the cabinet (close to a boundary) as opposed to a low pressure region (middle of the cabinet) for conventional ducted ports. Furthermore, organ-pipe resonances are both suppressed and contained. Finally, and importantly, the present invention as shown in FIG. 3 offers the possibility of highly efficient, low noise vents tuned to very low frequencies which will fit in smaller cabinets.

There are at least two instances in the prior art in which a loudspeaker configuration has employed a single disk or plate adjacent to and spaced from a port opening, although not for the purpose of nor achieving the results of the present invention. One such instance in the prior art is the configuration disclosed in U.S. Pat. No. 5,056,616 to Astrom. In that patent, there is disclosed placement of an outer baffle a small distance in front of an aperture or opening in a loudspeaker cabinet which is otherwise closed. A loudspeaker is mounted to the outer baffle such that the inner side of the speaker membrane is surrounded by the aperture or opening in the cabinet. In FIG. 9 of this patent, however, there is shown such an arrangement in which the loudspeaker is mounted elsewhere in the cabinet. In either configuration, in the narrow gap thus formed between the opening and outer baffle there are a number of small side apertures or "gap apertures" through which the sound can pass outwardly. The object of the Astrom patent is to broaden the system resonance and lower the system Q. The patent teaches that this is accomplished by tuning the multiple "gap apertures" to different frequencies. It discloses that this may be accomplished by using the "sound barriers" to create sound passages of different lengths terminating in multiple "gap apertures" which collectively constitute less than 50% of the circumference of the baffle or plate. See Column 4, lines 43–46 of the Astrom patent.

The intention of multiply resonant operation in the Astrom patent is confirmed by the analogous electrical circuit, FIG. 12A which, along with its description in column 6, clearly shows that the air between the cabinet and gap system Mip, is intended to oscillate independently of the air in the gap system, Mvs, and the multiple independent oscillating air masses, Mpi, of the individual gap apertures. This arrangement would not achieve the advantages of the present invention. In particular, the mass of air contained in the duct of the present invention is specifically intended to oscillate more or less as a single unitary mass.

The other prior art instance of a disk or plate being spaced in front of a port or duct is U.S. Pat. No. 4,611,686 to Kobayashi et al. In that patent a ducted loudspeaker system is shown in which a port is blocked by a plate with a smaller area that the port, such that a peripheral slit is created that is significantly smaller than the cross sectional area of the port. The purpose of the arrangement is to reduce intermediate frequency sound leakage through the duct or port to minimize interference with forward radiated intermediate frequency sound from active loudspeakers. Otherwise, the arrangement does not achieve the very significant advantages obtained by the present invention and is contrary to the aims of the present invention in that it actually reduces the cross sectional area of the duct at one end, see column 2, lines 65–68

Figure 4:
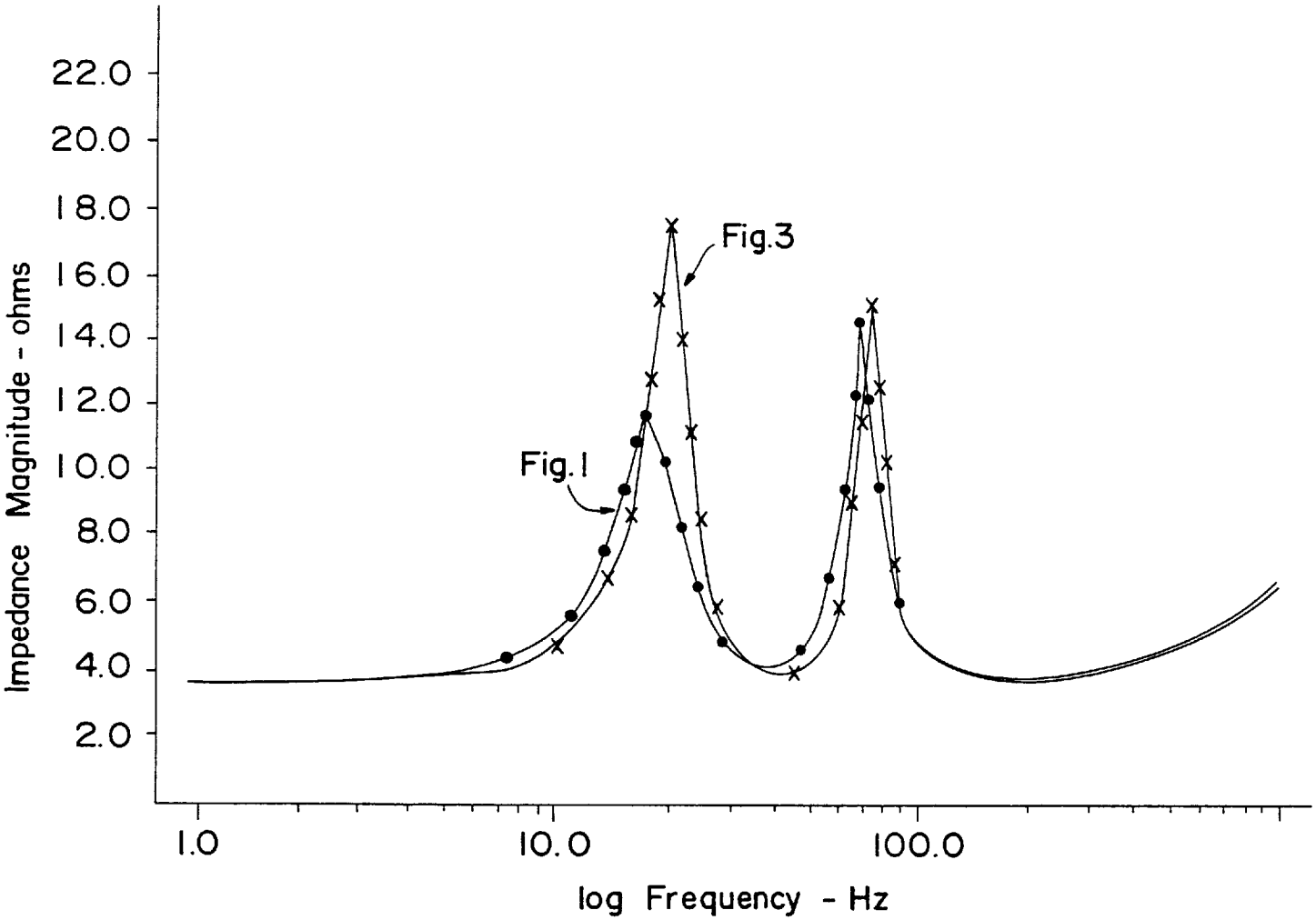
FIG. 4 is an impedance curve showing measurements carried out on an embodiment of the invention as shown in FIG. 3 vs. a prior art system as shown in FIG. 1.

To validate the performance advantages provided by the present invention, measurements were carried out on one embodiment of the invention as shown in FIG. 3 compared to an otherwise identical tuned system constructed as shown in FIG. 1. FIG. 4 shows an impedance curve of both systems where the solid line is the system of FIG. 1 and the dotted line that of the FIG. 3 embodiment of the present invention. As can be seen from FIG. 4, the tuning frequencies are very nearly the same, showing less than a 10% shift. However, the reduced mechanical loss of the embodiment of the present invention is evident from the much higher Q of the lower resonant peak in the impedance curve corresponding to the FIG. 3 embodiment of the present invention.

Figure 5:
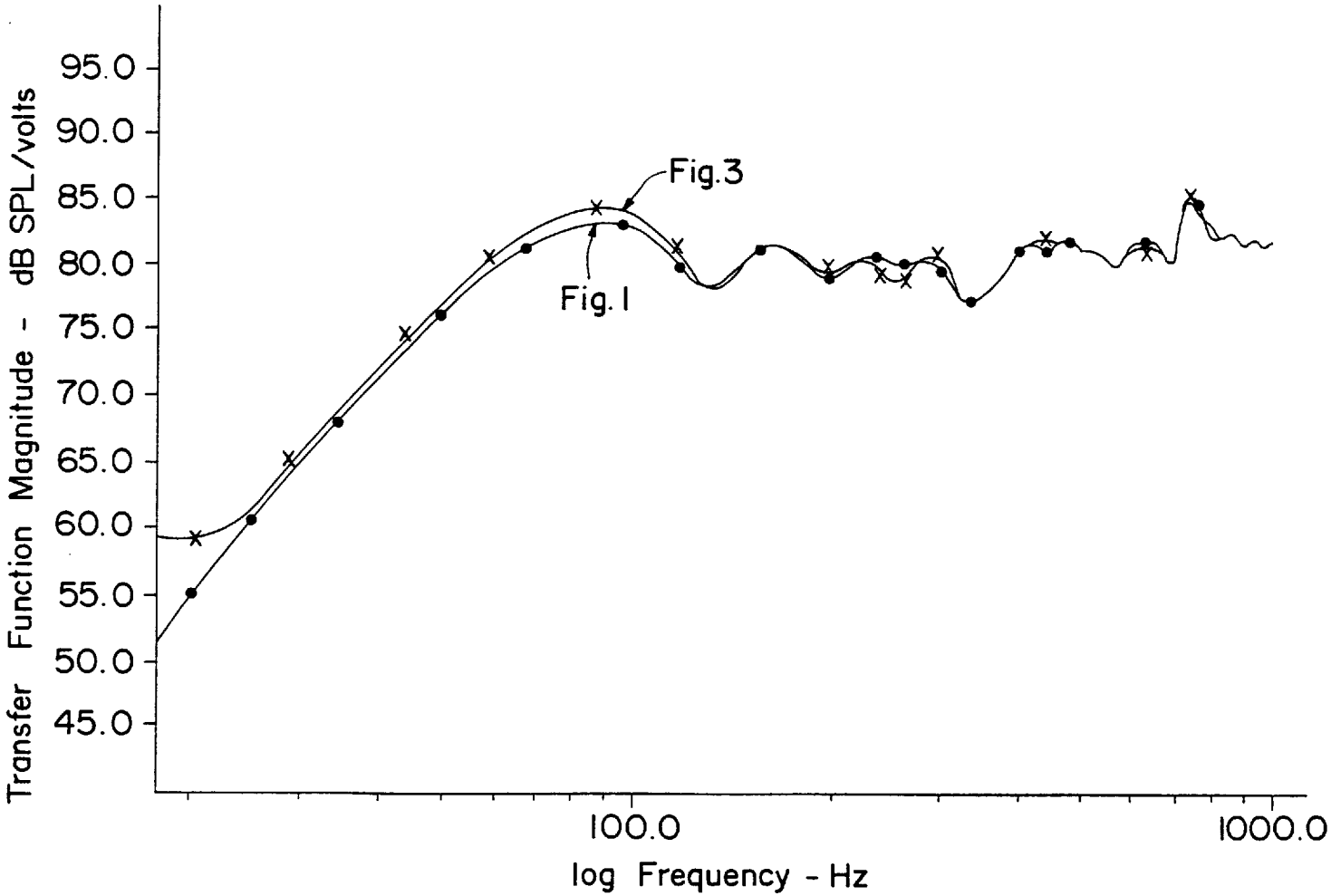
FIG. 5 shows an anechoic frequency response curve for the systems of FIG. 1 and FIG. 3.

FIG. 5 shows an anechoic frequency response curve for the systems of FIG. 1 and FIG. 3, measured at 1 meter using a ground-plane technique in a suitable semi-anechoic room. These frequency response curves show increased output from the FIG. 3 embodiment of the present invention over virtually the entire low-frequency range below 130 Hz. The increase reaches a maximum of about 1.5 db between 80 and 90 Hz. This corresponds to approximately a 20% increase in low frequency output which is attributed to the present invention. Listening evaluations have confirmed the improvement in low-frequency response afforded by the present invention without the introduction of anomalies in other frequency ranges.

Figure 7:
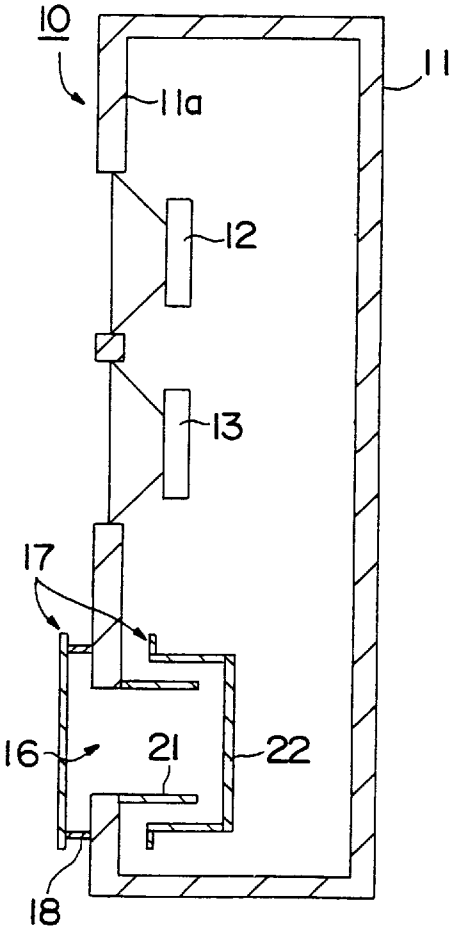
FIG. 7 is a diagrammatic side sectional view of still another alternate embodiment of the invention.
Figure 6:
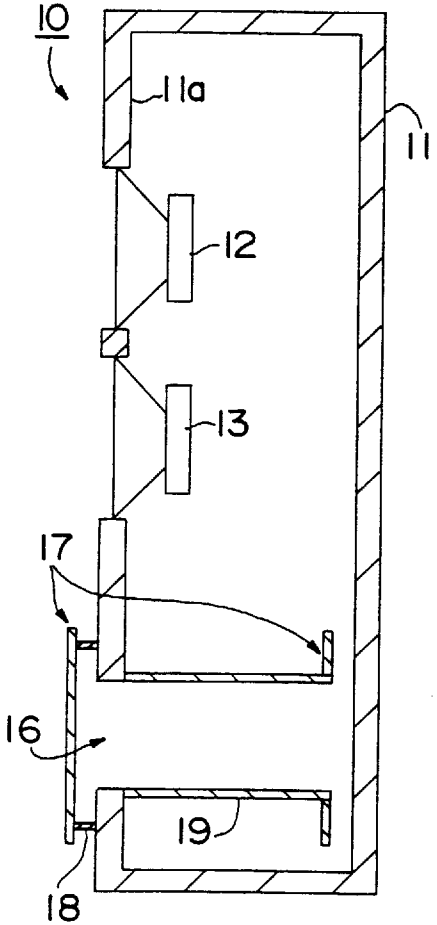
FIG. 6 is a diagrammatic side sectional view of an alternate embodiment of the invention.

It should be apparent to anyone skilled in the loudspeaker art that numerous variations and enhancements on the basic concept of the present invention shown in FIG. 3 are possible. For example, a very low tuning frequency or alternatively, the equivalent of a very long, large diameter duct can be obtained by increasing the length of straight ducting between disks. FIG. 6 shows one such example in which like reference numerals are used as in FIG. 3 to refer to corresponding elements. The alternate embodiment shown in FIG. 6, in which the port is extended through ducting 19 extending into the interior of the cabinet, would give approximately the same tuning performance as the FIG. 3 embodiment, but with even greater gains in performance. The same is true for the alternate embodiment shown in FIG. 7, in which the ducting is extended into the interior of the cabinet using "folded" ducting elements 21 and 22.

Figure 8:
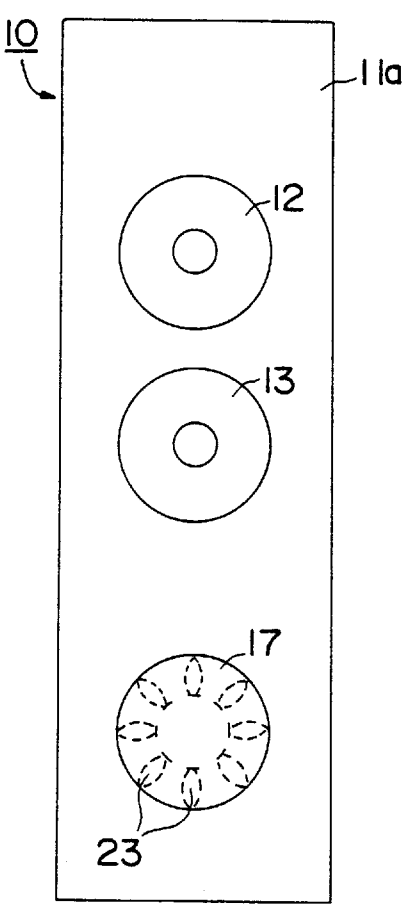
FIG. 8 is a front elevation of another embodiment of the invention in which shaped spacers are utilized to tailor the flare rate.

In the embodiment of the invention shown in FIG. 3, the struts 18 used to support the disks are purposefully small and configured such as not to significantly interfere with air flow. The purpose is to achieve a linear flare rate. It is also possible and within the scope of this invention to achieve a flare rate on either or both sides of a port which is not linear. This can be achieved through use of shaped spacers to mount the disks to the front baffle which do affect the air flow. One such possible arrangement in indicated in FIG. 8, in which like reference numerals are used as in FIG. 3 to refer to like elements. FIG. 8 is a front elevation of a speaker system in accordance with the present invention, and shaped spacer elements 23 illustrated in dotted lines can be used to achieve exponential or other flare rates. Of course, any particular desired flare rate could be achieved using particular shapes and sizes of spacers, and the shapes and sizes of the spacer to achieve the desired flare rate can be determined without undue experimentation.

Many other variations and extensions of the present invention are possible. For example, the flare rate could also be affected by and tailored through use of suitable contours on the disk surfaces facing the port, for example, convex. A further alternative is that the duct itself or the endplates or disks may be any shape whatsoever so long as at least the ends of the duct achieve a smooth and steadily increasing cross-sectional area through use of two disks or plates substantially in parallel at either end of the duct. Thus, although the word "disk" has been used to refer to the elements 17 shown in the drawings, it is expressly contemplated that these elements need not be circular, but can be square or any other shape desired in connection with design criteria. Further, the present invention may be employed to advantage in any application where a conventional ducted port or passive radiator could be used. For example and not by way of limitation, these might include conventional ported loudspeaker systems and band-pass type loudspeaker systems.

I claim:

1. A loudspeaker system comprising a cabinet containing at least one distinct air volume, at least one active loudspeaker transducer mounted to said cabinet and at least one passive radiating element connecting the air volume inside the cabinet to air outside the cabinet for the purpose of radiating sound, and wherein said at least one passive radiating element comprises a duct configured to provide an acoustic mass of air tuned to a single frequency and moving substantially as a unitary mass in the process of radiating sound, said duct comprising a straight section with constant cross-sectional area along its length, and being attached at least one end to a duct structure having a varying cross-sectional area, the varying cross-sectional area being defined by a flat area on the cabinet surrounding said straight duct section, a first disk or plate larger in cross-sectional area than said straight duct section spaced a predetermined distance from the flat area on the cabinet and substantially concentric to said straight duct section, said first disk or plate being attached to said flat area by means substantially small compared to the circumference of said first disk or plate so as not to interfere significantly with the flow of air between the flat area and first disk or plate, said duct structure having a varying cross-sectional area which increases from the straight duct section to a larger cross-sectional area defined by the circumference of said first disk or plate, thereby configuring an acoustic mass of air tuned to a single frequency and moving substantially as a unitary mass in the process of radiating sound and having no straight-line path from the air volume inside said cabinet to air outside said cabinet.

2. The loudspeaker system of claim 1 wherein the predetermined distance between said first disk or plate and the flat area on the cabinet at one end of said straight duct section is selected such that an area measurement resulting from multiplying the circumference of the first disk or plate by the predetermined distance is approximately equal to the area of the straight duct section.

3. The loudspeaker system of claim 1 in which a surface of said first disk or plate facing the port is contoured to produce a non-linear flare rate with respect to air passing therethrough.

4. A loudspeaker system comprising a cabinet containing at least one distinct air volume, at least one active loudspeaker transducer mounted to said cabinet and at least one passive radiating element connecting the air volume inside the cabinet to air outside the cabinet for the purpose of radiating sound, and wherein said at least one passive radiating element comprises a duct configured to provide an acoustic mass of air tuned to a single frequency and moving substantially as a unitary mass in the process of radiating sound, said duct comprising a straight section with constant cross-sectional area along its length, and being attached at least one end to a duct structure having a varying cross-sectional area, the varying cross-sectional area being defined by a flat area on the cabinet surrounding said straight duct section, a first disk or plate larger in cross-sectional area than said straight duct section spaced a predetermined distance from the flat area on the cabinet and substantially concentric to said straight duct section, a second disk or plate larger in cross-sectional area than said straight duct section spaced a predetermined distance from a second end of said straight duct section opposite said first end and substantially concentric to said straight duct section, said first disk or plate being attached to said flat area by means substantially small compared to the circumference of said first disk or plate so as not to interfere significantly with the flow of air between the flat area and first disk or plate, said duct structure having a varying cross-sectional sectional area which increases from the straight duct section to a larger cross-sectional area defined by the circumference of said first disk or plate, thereby configuring an acoustic mass of air tuned to a single frequency and moving substantially as a unitary mass in the process of radiating sound and having no straight-line path from the air volume inside said cabinet to air outside said cabinet.

5. A loudspeaker system comprising a cabinet containing at least one distinct air volume, at least one active loudspeaker transducer mounted to said cabinet and at least one passive radiating element connecting the air volume inside the cabinet to air outside the cabinet for the purpose of radiating sound, and wherein said at least one passive radiating element comprises a duct configured to provide an acoustic mass of air tuned to a single frequency and moving substantially as a unitary mass in the process of radiating sound, said duct comprising a straight section with constant cross-sectional area along its length, and being attached at at least one end to a duct structure having a varying cross-sectional area, the varying cross-sectional area being defined by a flat area on the cabinet surrounding said straight duct section, a first disk or plate larger in cross-sectional area than said straight duct section spaced a predetermined distance from the flat area on the cabinet and substantially concentric to said straight duct section, a second disk or plate larger in cross-sectional area than said straight duct section, said straight duct section extending from said flat area on said cabinet back into the air volume inside said interior of the cabinet, with said second disk or plate suitably secured to an end of said straight duct section interior to the cabinet and concentric to said straight duct section, said first disk or plate being attached to said flat area by means substantially small compared to the circumference of said first disk or plate so as not to interfere significantly with the flow of air between the flat area and first disk or plate, said duct structure having a varying cross-sectional area which increases from the straight duct section to a larger cross-sectional area defined by the circumference of said first disk or plate, thereby configuring an acoustic mass of air tuned to a single frequency and moving substantially as a unitary mass in the process of radiating sound and having no straight-line path from the air volume inside said cabinet to air outside said cabinet.

* * * * *